United States Patent [19]

Weast

[11] 4,291,469

[45] Sep. 29, 1981

[54] ARCHERY BOW MOUNT FOR TELESCOPIC SIGHT

[76] Inventor: Norman J. Weast, 20821 Grand River, Detroit, Mich. 48219

[21] Appl. No.: 39,110

[22] Filed: May 15, 1979

[51] Int. Cl.[3] ..... F41G 1/00

[52] U.S. Cl. ..... 33/265; 124/23 R; 124/78

[58] Field of Search ..... 124/87, 88, 86, 24 R, 124/23 R; 33/265

[56] References Cited

U.S. PATENT DOCUMENTS 2,351,103 6/1944 Brown ..... 33/265

3,266,149 8/1966 Powell ..... 33/265

*Primary Examiner*—Richard C. Pinkham

*Assistant Examiner*—William R. Browne

*Attorney, Agent, or Firm*—Charles W. Chandler

[57] ABSTRACT

A base plate is attached to the midsection of an archery bow, and a pair of spaced, aligned rings fastened to the base plate for supporting a telescopic sight.

3 Claims, 11 Drawing Figures

ARCHERY BOW MOUNT FOR TELESCOPIC SIGHT

BACKGROUND OF THE INVENTION

This invention is related to means for mounting telescopic sights on archery bows, and more particularly to means for mounting a sight, normally used on a firearm, on the midsection of an archery bow.

Archers usually obtain better results in hunting with bow and arrow when they employ some form of sighting means. The prior art includes means for mounting a telescopic sight on an archery bow, for example, U.S. Pat. No. 3,266,149 which issued to L. Y. Powell. However, such mounts have not been widely commercially used.

SUMMARY OF THE INVENTION

The broad purpose of the present invention is to provide a base plate that is fastened to the midsection of a bow for accommodating commercially available mounts for telescopic sights. In the preferred embodiment of the invention, the base plate is adapted for connecting a pair of conventional ring mounts for supporting a telescopic sight. The base plate also has opposed grooves for supporting a pair of see-through mounts of the type disclosed in U.S. Pat. No. 4,026,055, issued to Gerald T. Weast, in which a pair of cooperating members are clamped both on opposite sides of a telescopic sight and the opposite sides of the base plate.

Still further objects and advantages of the present invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
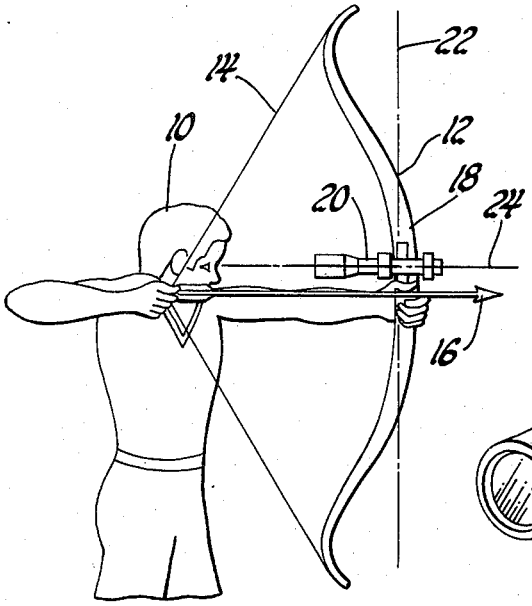
FIG. 1 illustrates an archer aiming an archery bow having a telescopic sight mounted in accordance with the preferred embodiment of the invention.

Referring to the drawings, FIG. 1 illustrates an archer 10 holding a bow 12 having a taut bow string 14 for shooting an arrow 16. Bow 12 has a conventional midsection 18 grasped by the archer. A conventional telescopic sight 20 is mounted on the midsection of the bow. It is to be noted that the bow midsection has a longitudinal axis generally indicated at 22, and that sight 20 is supported such that its longitudinal axis 24 is generally at right angles to axis 22.

Figure 3:
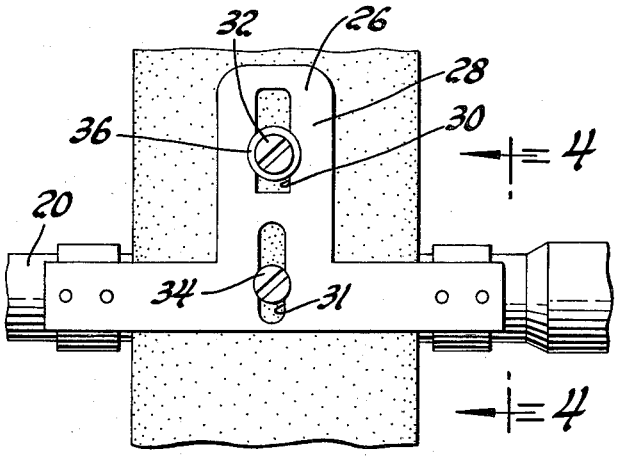
FIG. 3 is a view of the base plate.

Referring to FIG. 3, a base plate 26 is mounted on bow midsection 18. The base plate has elongated vertical section 28 having an upper wide slot 30 and a lower narrow slot 31 receiving a pair of fasteners 32 and 34. Fastener 32 is narrower than slot 30 and mounted on washer 36 so that the plate can be pivoted about fastener 34 to a selected position. Base plate 28 has an elongated base 38 which extends from opposite sides of vertical section 28 and beyond opposite edges of bow midsection 18.

Figure 2:
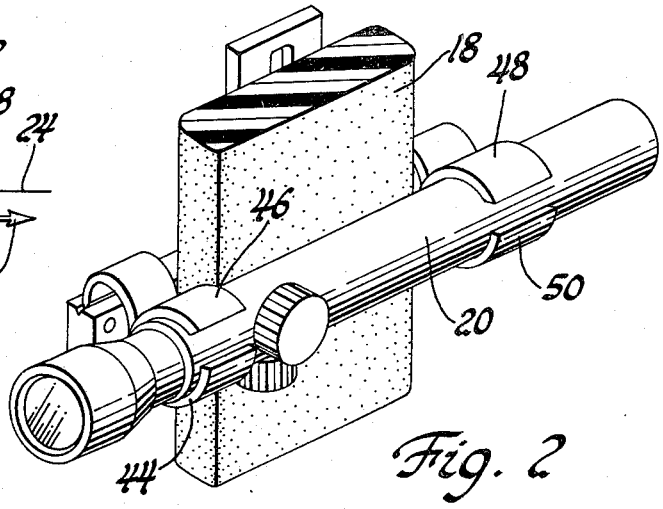
FIG. 2 is an enlarged perspective view of the mounting means of FIG. 1.
Figure 4:
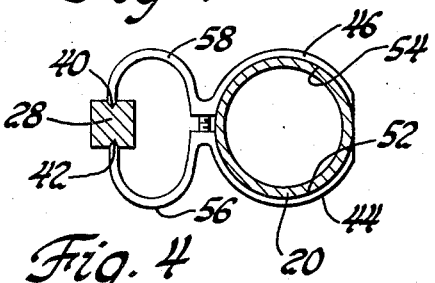
FIG. 4 is a view taken along lines 4—4 of FIG. 3.

Referring to FIGS. 2 and 4, the base plate has a pair of V-shaped grooves 40 and 42 along opposite side edges of the base plate.

A pair of cooperating clamping members 44 and 46 support the rear end of the sight, and a second pair of cooperating clamping members 48 and 50 support the forward end of the sight on the bow. Clamping members 44 and 46 are identical with respect to clamping members 48 and 50. Referring to FIG. 4, clamping member 44 has an upper wall with a substantially semi-cylindrical surface 52 receiving one lateral side of sight 20. Clamping member 46 has a substantially semi-cylindrical surface 54 engaging the opposite side of the sight.

Clamping member 44 has a lower half forming a curved wall 56 spaced from a similarly shaped curved wall 58 on the lower half of clamping member 46. Walls 56 and 58 support the sight in a spaced relationship from the base plate, and when mounted on a firearm having iron sights, permits the user to employ either the iron sights or the telescopic sight for aiming the weapon.

The edge of clamping member 44 is received in V-shaped groove 42 of the base plate, while the edge of clamping member 46 is received in V-shaped groove 40. Grooves 40 and 42 are elongated so that clamping members 44 and 46 can be slidably adjusted along the base plate to a selected position. Threaded fastener means 60 are mounted on the midsection of clamping members 44 and 46 so as to be operative to move clamping member 44 toward clamping member 46 when the sight is being clamped between them.

Figure 5:
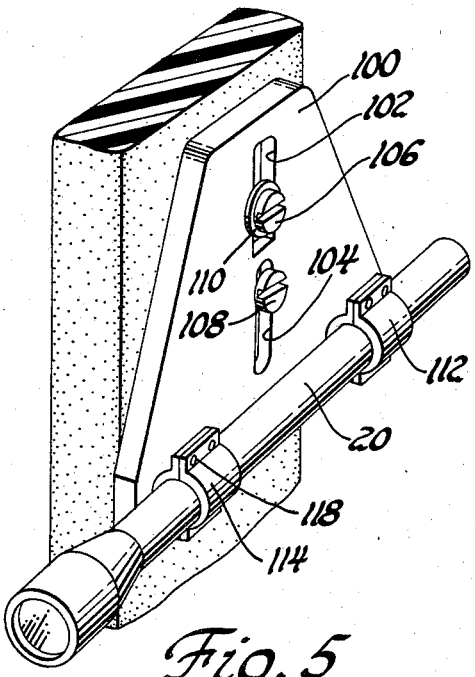
FIG. 5 is a view showing a telescopic sight supported by a pair of conventional mounting rings to another embodiment of the invention.
Figure 6:
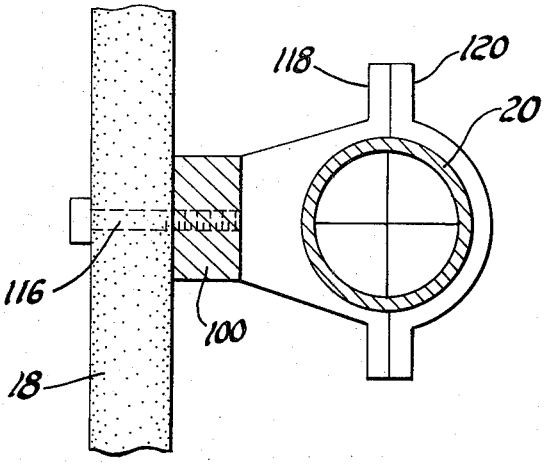
FIG. 6 is a view showing the manner in which the rings of FIG. 5 are connected to the base plate.

FIGS. 5 and 6 illustrate another embodiment of the invention in which base plate 100 is mounted on the same side of the bow midsection as sight 20. In this embodiment, the user employs opening means 102 and 104 in the base plate for receiving fastener means 106 and 108 and washer 110. A pair of spaced ring means 112 and 114 are connected by threaded fastener means 116 to plate 100. Each ring means has a lower ring half 118 and an upper ring half 120 connected together by appropriate fastening means 122 to cooperate in supporting sight 20 on the bow.

Base plate 100 can be employed for a variety of commercially available mounts to support a telescopic sight on either side of the midsection of a conventional archery bow.

Figure 7:
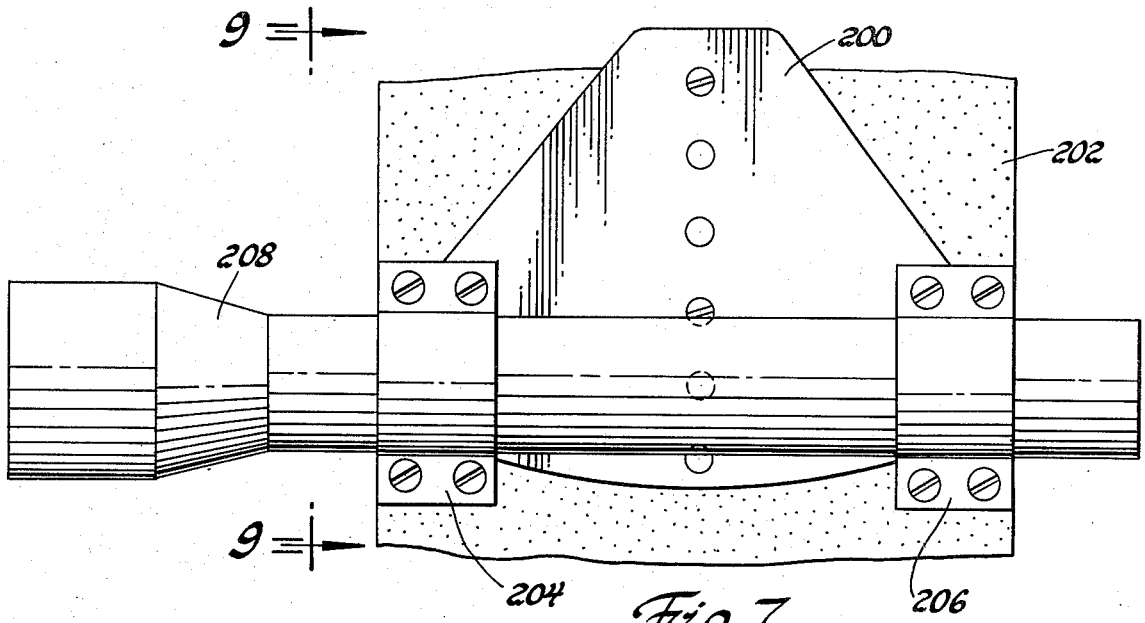
FIG. 7 is a view of another mounting plate arrangement for an archery bow.

FIG. 7 illustrates another embodiment of the invention including a base plate 200 mounted on the side of bow midsection 202. A pair of conventional ring means 204 and 206 are fastened to plate 200 for supporting telescopic sight 208.

Figure 8:
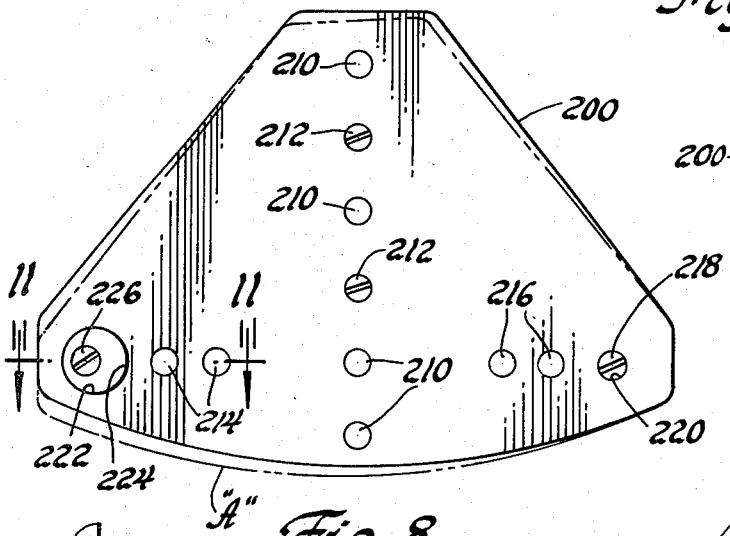
FIG. 8 is a view of the base plate similar to FIG. 7, but with the sight and rings removed from the plate.
Figure 11:
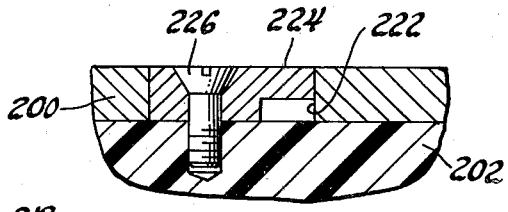
FIG. 11 is a view taken along lines 11—11 of FIG. 8.
Figure 9:
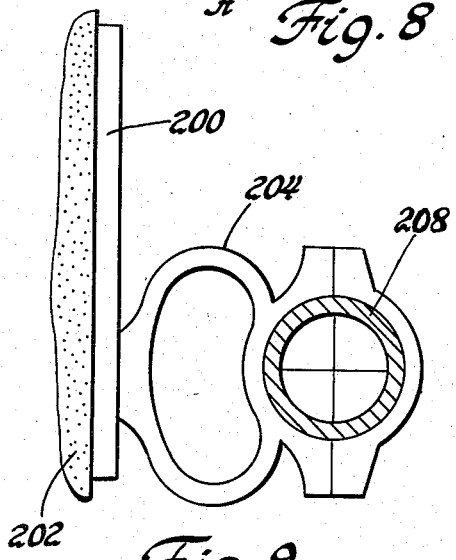
FIG. 9 is a view taken along lines 9—9 of FIG. 7.

FIG. 8 illustrates a series of six openings 210 in plate 200 for receiving fastener means 212 for fastening the plate to the bow when the plate's position has been properly adjusted. Plate 200 also has a pair of openings 214 for receiving fasteners for connecting ring means 204 to the plate, and a second pair of openings 216 for fastening ring means 206 to the plate. A fastener 218 is received through an opening 220 to connect one side of the plate to the bow. The opposite side of the plate has an opening 222 for receiving bushing 224. A fastener 226 fastens bushing 224 to the bow 202.

Fastener 226 is eccentrically located with respect to opening 222 as well as with respect to bushing 224. By rotating the fastener and the bushing, plate 200 can be pivoted around fastener 218 to a position illustrated in phantom at A in FIG. 8 in order to adjust the angle of the longitudinal axis of sight 208 with respect to the bow.

Figure 10:
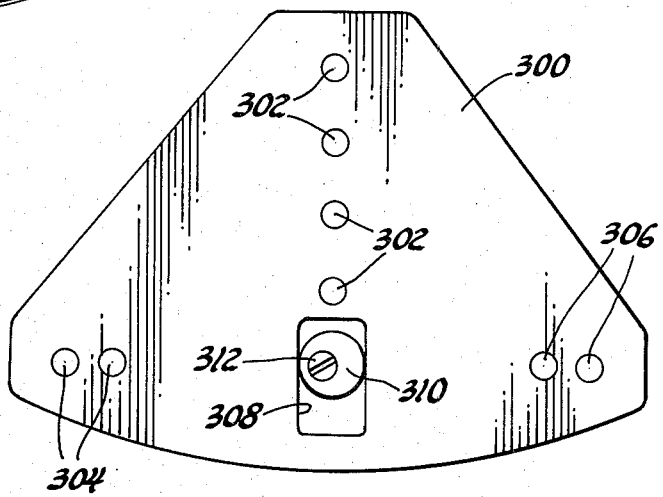
FIG. 10 is a view of still another mounting plate.

FIG. 10 illustrates still another base plate 300, similar to base plate 200. Base plate 300 has four openings 302 for attaching the plate to the archery bow. Plate 300 has a pair of openings 304 for fastening ring means 204, and a second pair of openings 306 for fastening ring means 206. Base plate 300 has a slot 308 with an eccentric bushing 310 which can be adjusted by rotating fastener 312 within the slot to adjust the angle of the base plate with respect to the bow. When the angle has been properly adjusted, the user then inserts appropriate fasteners in openings 302.

Having described my invention, I claim:

1. Means for mounting an elongated telescopic sight on the side of an archery bow comprising:

a telescopic sight;

a base plate;

a plurality of first fastening means for fastening the base plate to the side of the midsection of an archery bow having a longitudinal axis;

first ring means fastened to said base plate for receiving an elongated telescopic sight;

said base plate being on one side of the first ring means and said telescopic sight being positioned on the opposite side of the first ring means; and second ring means spaced from the first ring means generally along the axis of the telescopic sight and directly cooperating with the first ring means to support the telescopic sight such that the longitudinal axis of the sight is generally at right angles to the longitudinal axis of a bow, means on said plate for tilting said plate about an axis normal to a side of a bow when installed thereon.

2. A combination as defined in claim 1, in which said ring means comprises a first ring half, a second ring half and means for threadably fastening the second ring half to the first ring half to cooperate therewith to form a ring suited for receiving said telescopic sight.

3. A combination as defined in claim 2, in which the plate has an opening, and said means includes a member receivable in the opening such that a plate is pivotal about the member to an adjusted position on the side of the bow.

* * * * *